US005909930A

United States Patent [19]

Ragland, III et al.

[11] Patent Number: 5,909,930

[45] Date of Patent: Jun. 8, 1999

[54] RETRACTABLE BLADE UTILITY KNIFE HAVING QUICK CHANGE FEATURE

[75] Inventors: Howard Nicholas Ragland, III; James Felix Mariol, both of Cincinatti, Ohio

[73] Assignee: Millers Falls Tool Company, Cincinnati, Ohio

[21] Appl. No.: 08/906,793

[22] Filed: Aug. 5, 1997

[51] Int. Cl.[6] ..... B26B 1/08; B26B 5/00

[52] U.S. Cl. ..... 30/125; 30/335

[58] Field of Search ..... 30/125, 335–339

[56] References Cited

U.S. PATENT DOCUMENTS

| | | |
|---|---|---|
| D. 305,096 | 12/1989 | Tench et al. . |
| D. 347,563 | 6/1994 | Okada . |
| 2,172,072 | 9/1939 | Rothschild . |
| 4,277,888 | 7/1981 | Szabo . |
| 4,615,118 | 10/1986 | Ihata . |
| 5,005,290 | 4/1991 | Gilbert . |
| 5,025,558 | 6/1991 | Gilbert . |
| 5,502,896 | 4/1996 | Chen . |
| 5,509,205 | 4/1996 | Ragland, III . |
| 5,581,890 | 12/1996 | Schmidt . |

FOREIGN PATENT DOCUMENTS

| | | | |
|---|---|---|---|
| 2269128 | 2/1994 | United Kingdom | 30/335 |

*Primary Examiner*—Douglas D. Watts
*Attorney, Agent, or Firm*—Killworth, Gottman, Hagan & Schaeff, L.L.P.

[57] ABSTRACT

A utility knife having a preferred two piece construction is provided. The utility knife includes a knife handle of unitary construction and a blade carrier also of unitary construction. The blade carrier includes a cutting blade portion for engaging the cutting blade and a storage portion for engaging extra cutting blades. The blade carrier also includes a spring element having a button. The button includes a rib which engages notches located on a slot of the knife handle. The blade carrier, and hence the cutting blade, may be extended or retracted by depressing the button and moving the blade carrier within the knife handle. The blade carrier is locked in place as the rib on the button engages one of the notches in the slot. The blade carrier is removed from the knife handle by depressing the button and passing the blade carrier through an inner portion of the knife handle.

25 Claims, 7 Drawing Sheets

RETRACTABLE BLADE UTILITY KNIFE HAVING QUICK CHANGE FEATURE

BACKGROUND OF THE INVENTION

The present invention relates to utility knives, and more particularly to utility knives having retractable blades and in which the blades may be changed quickly in use.

Utility knives having replaceable blades and with a variety of end uses are well known in the art. Exemplary of such utility knives are U.S. Pat. Nos. 3,107,426, 3,872,591, 3,577,637, 4,242,795, 4,586,256, and 4,663,845. Such knives incorporate a blade carrier which mounts and supports a blade in the interior of the knife handle. The blade carrier may also incorporate a thumb actuated button that is depressed to unlatch the blade carrier and blade from one of several latched positions and then moved forwardly or rearwardly to extend or retract the blade.

As use of the blades causes them to dull, the blades need to be replaced on a fairly frequent basis. The respective knives are adapted so that mounting and replacement of the blades is relatively simple. For example, in many instances, the knife comprises a pair of complementary halves which are held together by a screw or the like. Loosening or removal of the screw permits the knife to be disassembled and the blade accessed. However, even this relatively simple operation becomes tedious and time consuming for the user.

However, while such knife designs generally operate in an efficient manner, one continuing problem with them has been the tendency of the blades to release or disengage from the blade carrier during heavy use, particularly where strong lateral or twisting forces are imposed on the cutting edge of the blade. The twisting or lateral movement of the blade may cause the nose of the matching knife halves to open slightly, as the knife handle halves are typically secured only at their midpoint by a single screw. This, in turn, may permit the blade to release from the blade carrier and the knife handle, resulting in the need to stop using the knife and to reassemble the knife and blade. The release of the blade from the knife during use also potentially poses a safety problem.

Other utility knives have utilized designs where one portion of the knife handle is wedged into position and locked with a bolt with a knurled head for finger operation located at the rear of the knife. Still other utility knives have utilized designs where the matching knife handle halves are rotatable about their midpoints to open the knife and expose the blade for removal. Such knives typically also include some type of locking mechanism in the knife handle to insure that the handle halves do not rotate and open the knife accidentally. However, these knife designs suffer from their complexity both in the number of parts required for the knife as well as in their manufacturing and assembly.

Accordingly, a need still exists in the art for a utility knife design which is both simple to manufacture, has a minimum number of parts, and yet provides the user with the ability to remove and change blades quickly.

SUMMARY OF THE INVENTION

The present invention meets those needs by providing a retractable blade utility knife having, in its most preferred form, only two parts, which is simple and inexpensive to manufacture, and yet which provides a user with the ability to change blades simply, quickly, and without the need for a screwdriver or other tool.

According to a first aspect of the present invention, the utility knife includes a knife handle having a blade opening at a first end of the handle, a second opening at an opposite end of the handle, a slot on a surface of the knife handle, and an inner portion. The utility knife also includes a replaceable blade for the knife and a blade carrier adapted for mounting the replaceable blade thereon. The blade carrier includes a spring element having a button. The spring element is adapted to engage the slot on the knife handle when the blade carrier is inserted into the inner portion of the knife handle through the second opening. The blade carrier may be removed from the knife handle through the second opening therein by depressing the button through the slot to the inner portion of the knife handle to permit the blade to be replaced.

Preferably, the knife handle is of unitary construction and comprised of a die cast metal. The blade carrier is preferably of unitary construction and comprised of a molded plastic. Preferably, the spring element and the button are integral with the blade carrier while a first end of the spring element and a first portion of the blade carrier form a living hinge. The second end of the spring element includes a flange and a second portion of the blade carrier includes a flange slot with the flange of the spring engaging the flange slot of the blade carrier.

Preferably, the spring element is adapted to engage a plurality of notches within the slot. Further, the button may include at least one laterally extending rib which is adapted to engage the notches of the slot. Preferably, the replaceable blade includes at least one locating notch along an edge thereof and the blade carrier includes at least one post for receiving the notch in the blade when the blade is mounted on the blade carrier. The blade carrier may include a blade storage area in a recess thereof. Further, the blade storage area includes at least one post for receiving the locating notch in the blade when the blade is mounted in the blade storage area. Preferably, the inner portion of the knife handle includes at least one rib for supporting the blade within the knife handle.

According to another aspect of the present invention, the utility knife includes a knife handle having a blade opening at a first end of the handle, a second opening at an opposite end of the handle, and a slot on a top surface of the knife handle. The utility knife further includes a replaceable blade for the knife and a blade carrier adapted for mounting the replaceable blade thereon. The blade carrier includes a spring element adapted to engage the slot on the knife handle when the blade carrier is inserted into the knife handle through the second opening. The top surface of the knife handle is parallel to a cutting surface of the blade. The blade carrier may be removed from the knife handle by depressing the spring element through the slot and pulling the blade carrier through the second opening in the knife handle to permit the blade to be replaced.

Preferably, the knife handle is of unitary construction. The blade carrier is also preferably of unitary construction. The spring element may be adapted to engage a plurality of notches within the slot. The spring element may comprise a button having at least one laterally extending rib which engages the notches of the slot. Preferably, a first end of the spring element and a first portion of the blade carrier form a living hinge.

According to yet another aspect of the present invention, the utility knife includes a knife handle having a blade opening at a first end of the handle, a second opening at an opposite end of the handle, and a slot. The utility knife further includes a replaceable blade for the knife, and a blade carrier adapted for mounting the replaceable blade thereon.

The blade carrier includes a spring element adapted to engage the slot on the knife handle when the blade carrier is inserted into the knife handle through the second opening. The blade carrier may be removed from the knife handle by depressing the spring element through the slot and pulling the blade carrier through the second opening in the knife handle to permit the blade to be replaced. The blade carrier is of unitary construction.

Preferably, the knife handle is of unitary construction. The spring element is adapted to engage a plurality of notches within the slot. The spring element may comprise a button having at least one laterally extending rib which engages the notches of the slot. Preferably, a first end of the spring element and a first portion of the blade carrier form a living hinge.

Accordingly, it is a feature of the present invention to provide a utility knife which is reliable, easy to use, and simple and cost effective to manufacture. This, and other features and advantages of the present invention, will become apparent from the following detailed description, the accompanying drawings, and the appended claims.

DETAILED DESCRIPTION OF THE PREFERRED EMBODIMENTS

Figure 1:
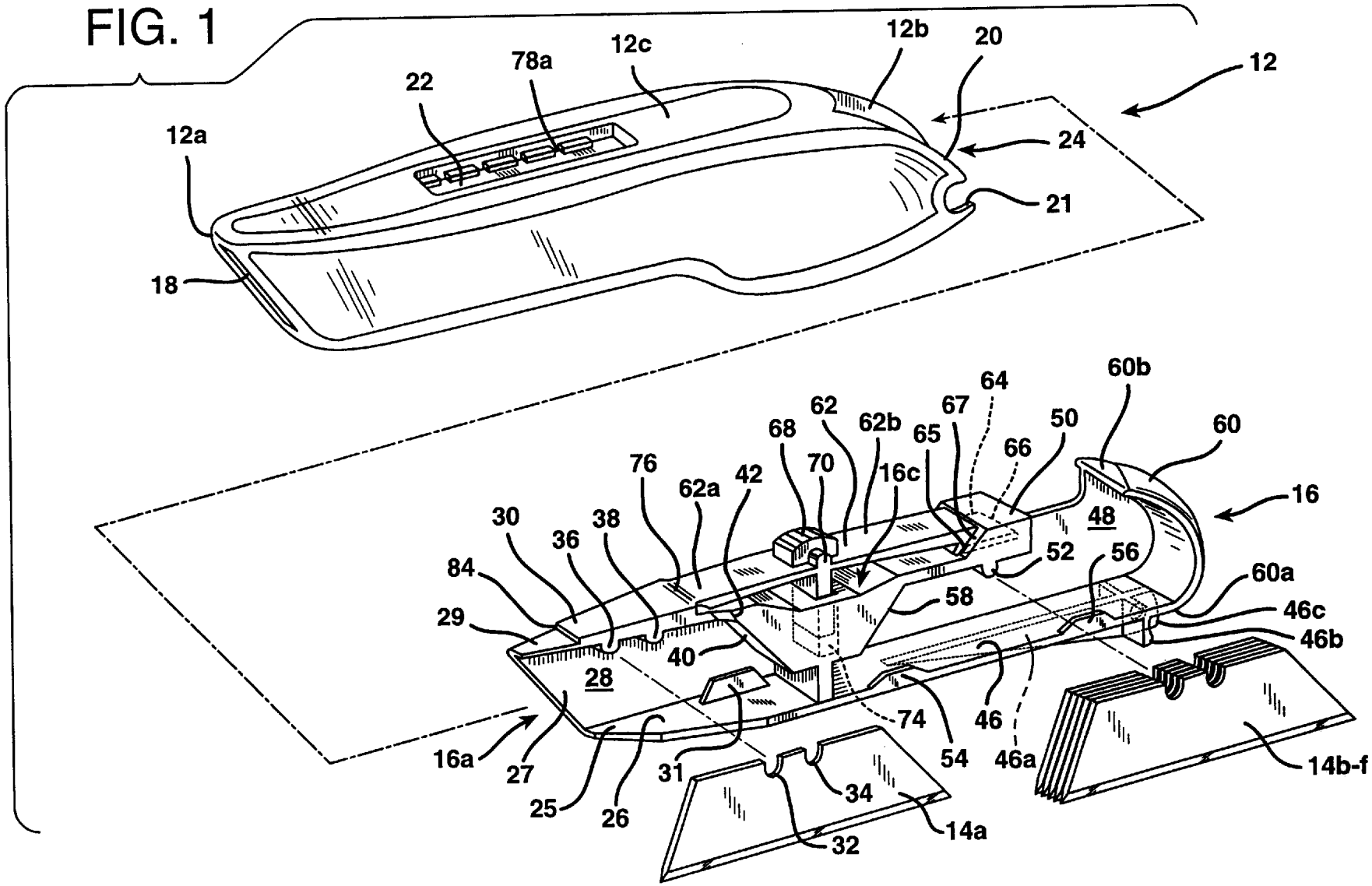
FIG. 1 is an exploded perspective view of a utility knife according to the present invention.

Referring now to FIG. 1, a utility knife 10 of the present invention is depicted in a preferred embodiment wherein the knife includes a retractable blade having a trapezoidal shape. However, it will be apparent to those skilled in the art that the invention also has applicability to non-retractable, fixed blade knives as well. Further, the blade may take a number of forms including the shape illustrated, a hook blade, a scoring blade, or any other form of blade which can be adapted for mounting to the blade carrier.

As shown in FIG. 1, the utility knife 10 includes a knife handle 12, replaceable blades 14*a,* 14*b–f* and a blade carrier 16. The cutting blade 14*a* is mounted within a first portion 16*a* of the blade carrier 16 and serves as the cutting blade for the utility knife 10. One or more extra blades 14*b–f* are mounted within a second portion 16*b* of the blade carrier 16 and serve as replacement blades for the cutting blade 14*a*. The second portion 16*b* functions as a blade storage area for the extra blades 14*b–f*. As illustrated, the cutting blade 14*a* and the extra blades 14*b–f* are of the same configuration. A third portion 16*c* of the blade carrier 16 separates the first portion 16*a* from the second portion 16*b*.

Figure 7:
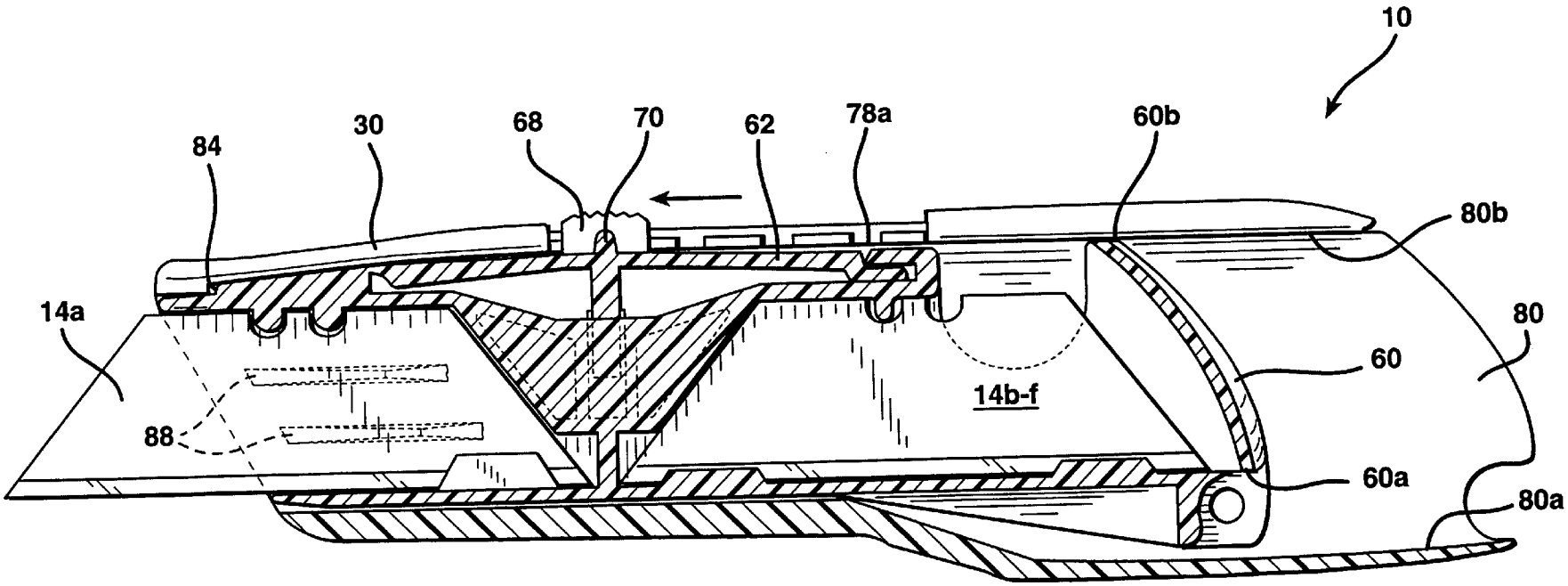
FIG. 7 is a cross-sectional view of the utility knife of FIG. 1 with the cutting blade in a fully extended position.

The knife handle 12 includes a blade opening 18 at a first end 12*a,* a second opening 20 at an opposite end 12*b,* a cut-out 21 at the bottom opposite end 12*b,* a slot 22 on a surface 12*c,* and an inner portion 24. In the illustrated embodiment, the knife handle 12 is shaped so as to be comfortable to grip in the hand of a user. The inner portion 24 of the knife handle 12 is hollow so as to accept the blade carrier 16 and the cutting blade 14*a* as shown in FIG. 7. The knife handle 12 is of a single piece, unitary construction and preferably formed of a die cast metal. Any suitable casting metal, such as zinc, may be used to form the knife handle 12. It will be appreciated by those skilled in the art that the knife handle 12 may also be formed of injection molded plastic or reinforced composite resins.

Figure 4:
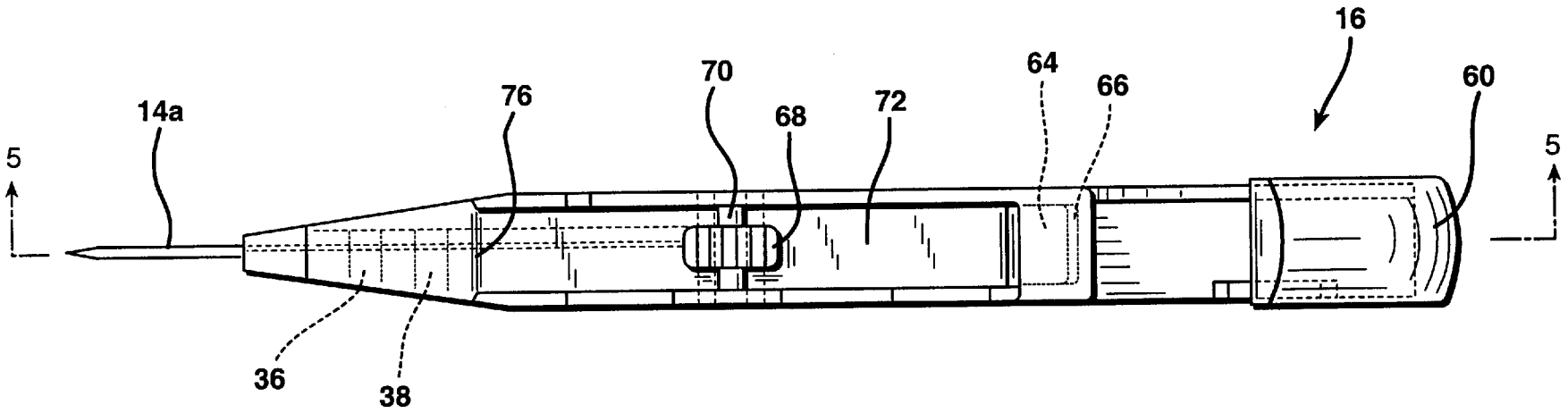
FIG. 4 is a top view of a blade carrier according to the present invention.
Figure 5:
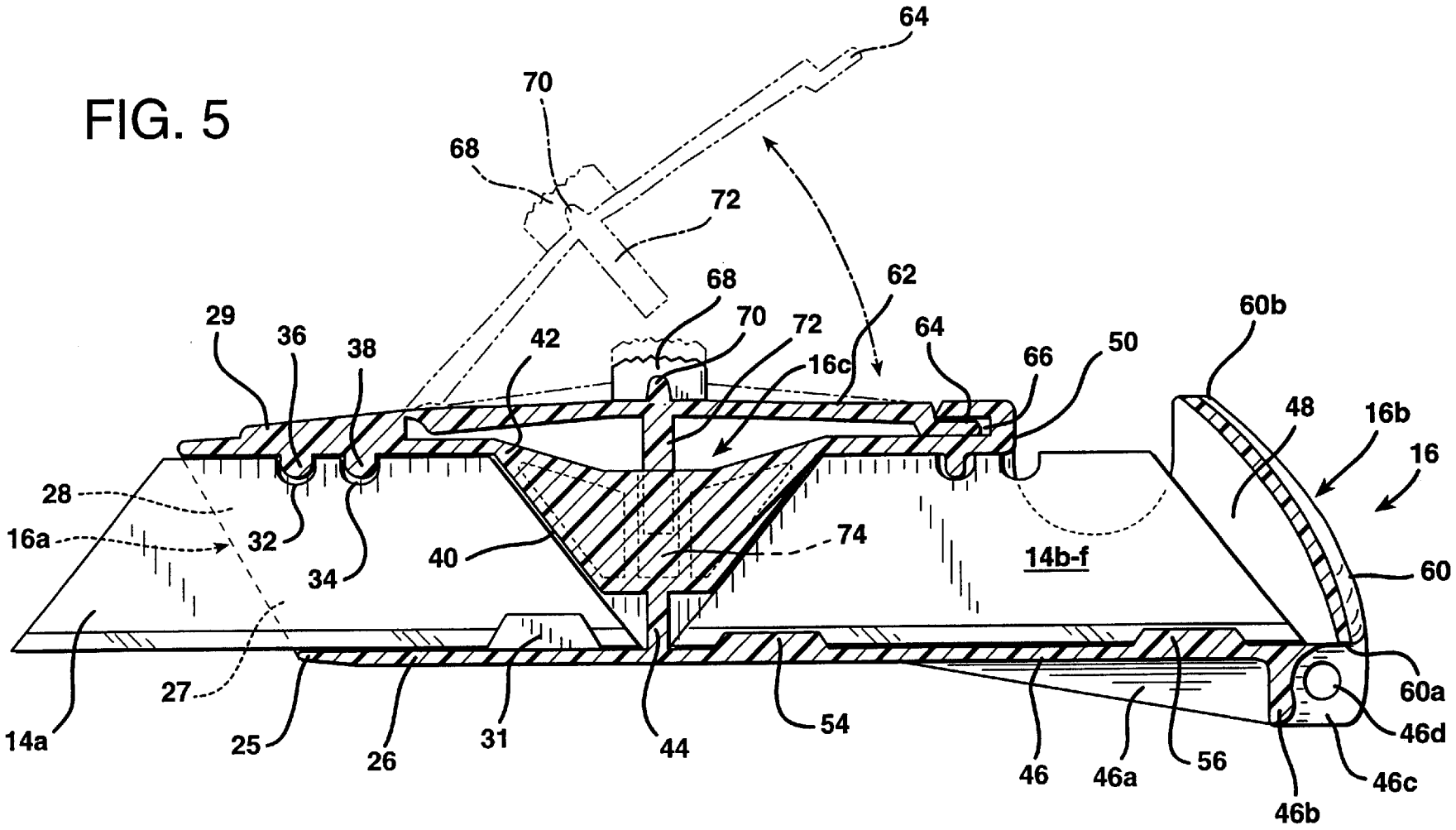
FIG. 5 is a cross-sectional view of the blade carrier taken along view line 5—5 in FIG. 4.

As shown in FIGS. 1, 4 and 5, the blade carrier 16 includes a laterally extending base 25, a side wall 27 and an upper wall 29. As shown, the base 25 is substantially perpendicular to the side wall 27. Within the first portion 16*a,* the base 25 includes a cutting blade base portion 26 on which the blade 14*a* rests. The side wall 27 includes a cutting blade side wall portion 28 for retaining one side of the blade 14*a*. The base portion 26 includes an upwardly extending cutting blade retaining flange 31 for retaining the blade 14*a* within the first portion 16*a*. In the illustrated embodiment, the retaining flange 31 is positioned slightly more than a blade's width from the side wall portion 28 so that the blade 14*a* is retained firmly against the side wall portion 28.

Within the first portion 16*a* of the blade carrier 16, the upper wall 29 includes a cutting blade upper wall portion 30, extending laterally from the side wall portion 28. The upper wall portion 30 engages the top edge of the blade 14*a* so that the blade 14*a* fits between the base portion 26 and the upper wall portion 30. The blade 14*a* includes at least one, and preferably two, locating notches 32, 34 which are sized to fit against posts 36, 38 extending from the upper wall portion 30. Typically, the notches 32, 34 are semi-circular in shape and mate with the semi-cylindrical shape of the posts 36, 38. The posts 36, 38 extend outwardly from the side wall portion 28 and terminate at the edge of the upper wall portion 30. The rear surfaces of the posts 36, 38 are integral with and form a part of the upper wall portion 30.

The third portion 16*c* of the blade carrier 16 extends outwardly from the side wall 27 of the blade carrier 16. A first edge 40 of the third portion 16*c* is angled to mate with the angle of the rear edge of the blade 14*a*. A first corner 42 of the third portion 16*c* is integral with the upper wall portion 30 while a connecting post 44 is integral with the base portion 26. When the blade 14*a* and notches 32, 34 are fitted into position to engage the posts 36, 38, the blade 14*a* is supported by the side wall portion 28, the base portion 26, the retaining flange 31, the posts 36, 38 and the first edge 40. The blade 14*a* is also restrained from longitudinal movement (i.e. movement to the left or right as shown in FIG. 1) as mounted in the blade carrier 16.

To insert the blade 14*a* in the blade carrier 16, the cutting edge of the blade 14*a* is angled downwardly so that the cutting edge is positioned between the side wall portion 28 and the retaining flange 31. The blade 14*a* is aligned within the first portion 16*a* of the blade carrier 16 so that the notches 32, 34 engage the posts 36, 38, respectively. The blade 14*a* is then dropped into position so that it rests against the side wall portion 26. The blade 14*a* is removed by pivoting the blade 14*a* on its cutting edge and lifting upwards away from the retaining flange 31. Typically, the unused cutting edge of the blade 14*a* may be used by flipping the blade 14*a* longitudinally and reinserting it into the blade carrier 16 so that the blade 14*a* is between the side wall portion 28 and the retaining flange 31, and the notches 34, 32 engage the posts 36, 38, respectively. In this manner, the entire cutting edge of the blade 14*a* may be used before a new blade 14*b* is needed.

Extra blades 14*b–f* may be stored in the second portion 16*b* prior to use. Within the second portion 16*b*, the base 25 includes an extra blade base portion 46 for retaining one edge of the extra blades 14*b–f*. The side wall 27 includes a generally flat extra blade side wall portion 48 on which the extra blades 14*b–f* rest. The cutting edge of the extra blades 14*b–f* rest on the base portion 46.

Within the second portion 16*b* of the blade carrier 16, the upper wall 29 includes an extra blade upper wall portion 50, extending from the side wall portion 48. The extra blade upper wall portion 50 engages the top edge of the blades 14*b–f* so that the blades 14*b–f* fit between the base portion 46 and the upper wall portion 50. The upper wall portion 50 includes at least one post 52 for mating with one of the locating notches 32, 34 of the blades 14*b–f*. As with the posts 32, 34 of the first portion 16*a*, post 52 is semi-cylindrical in shape for mating with one of the semi-circular notches 32, 34. The post 52 extends upwardly from the side wall portion 48 and terminates at the upper surface of the upper wall portion 50. The rear surface of the post 52 is integral with and forms a part of the upper wall portion 50. The base portion 46 also includes at least one, and preferably two upwardly extending extra blade retaining flanges 54, 56. The retaining flanges 54, 56 function to retain the extra blades 14*b–f* within the second portion 16*b* during use and/or replacement of the cutting blade 14*a*.

A second edge 58 of the third portion 16*c* is angled to mate with the angle of the rear edge of the extra blades 14*b–f*. A second corner 59 of the third portion 16*c* is integral with the upper wall portion 50 while the connecting post 44 is integral with the extra blade base portion 46. As illustrated, the connecting post 44 separates the cutting blade base portion 26 from the extra blade base portion 46.

Figure 3:
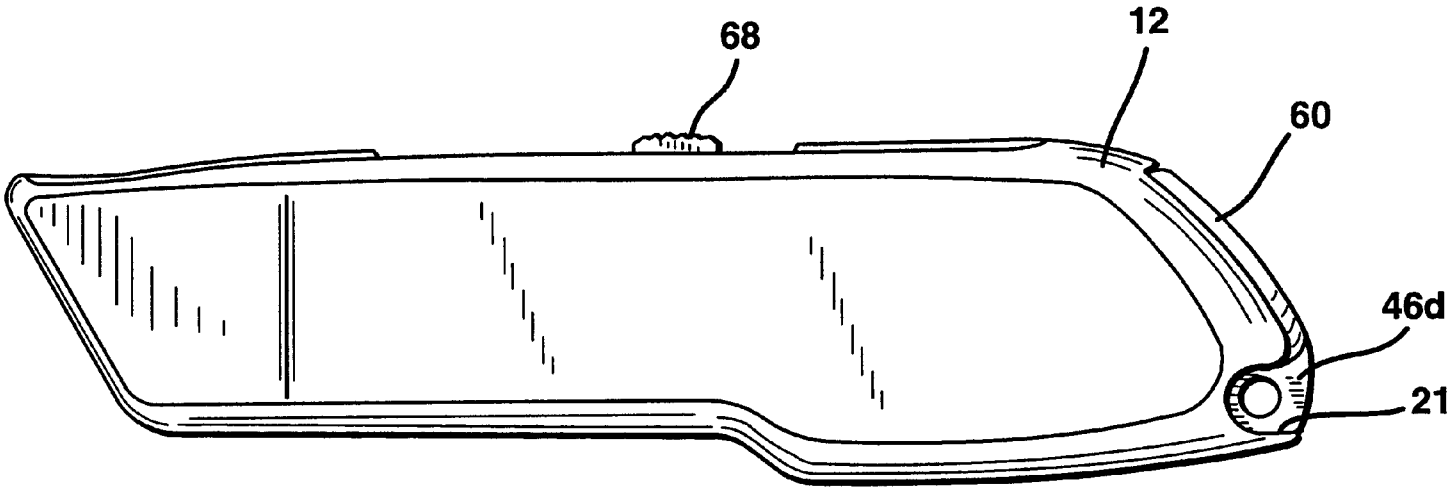
FIG. 3 is a side view of the utility knife of FIG. 1.

The second portion 16*b* also includes a rounded cover portion 60 extending outwardly from the side wall 29. The cover portion 60 is integral with and extends over the extra blade base portion 46. As illustrated, the cover portion 60 is shaped to conform with the profile of the second opening 20 and the cut-out 21 of the knife handle 12. When the extra blades 14*b–f* and one of the notches 32, 34 are fitted into position to engage the post 52, the extra blades 14*b–f* are supported by the side wall portion 48, the base portion 46, the upper wall portion 50, the post 52, the second edge 58 and the retaining flanges 54, 56. It will be appreciated by those skilled in the art that the extra blades 14*b–f* may be stored in the second portion 16*b* without the need for the post 52. The extra blades 14*b–f* may simply be supported between the side wall portion 48, the base portion 46, the upper wall portion 50, the second edge 58 and the retaining flanges 54, 56. As shown in FIGS. 1 and 5, the base portion 46 includes a slope portion 46*a* extending from the bottom of the base portion 46, a shoulder portion 46*b* extending across the bottom of the base portion 46 and an extension portion 46*c* adjacent the cover portion 60. The sloped portion 46*a* and the extension portion 46*c* are positioned substantially in the middle of the bottom of the base portion 46 and are separated by the shoulder portion 46*b*. As shown in FIG. 3, the extension portion 46*c* corresponds in size to the cut-out portion 21 and provides a grippable surface to allow for easy removal of the blade carrier 16 from the handle 12. The extension portion 46*c* may also include an opening 46*d* for mounting of the utility knife 10 on a peg board or the like.

Referring now to FIGS. 1 and 5, the extra blades 14*b–f* are inserted into the second portion 16*b* by placing the cutting edge of the blades 14*b–f* against the base portion 46 and aligning one of the notches 32, 34 with the post 52. The extra blades 14*b–f* are then dropped into position. Extra blades 14*b–f* are removed by tilting the blades upwards from the post 52 and lifting upwards away from the flanges 54, 56. The second portion 16*b* may accommodate a reasonable number of extra blades 14*b–f* depending on the width of the blade carrier 16. It will be appreciated by those skilled in the art that the width of the blade carrier 16 may be any reasonable size. It should be apparent that the width of the blade carrier 16 is dependent on the width of the inner portion 24 of the knife handle 12.

The blade carrier 16 includes a spring element 62. A first end 62*a* of the spring element 62 is coupled to the first portion 16*a* along the cutting blade upper wall portion 30. A second end 62*b* of the spring element 62 includes a flange 64 which engages a corresponding flange slot 66 within the extra blade upper wall portion 50. The second end 62*b* of the spring element 62 includes a recessed beveled shape surface 65 which corresponds to and engages a complementary beveled shaped surface 67 of the extra blade upper wall portion 50. The spring element 62 also includes a thumb button 68 having at least one laterally extending rib 70 and a post 72 which engages a corresponding pocket 74 within the third portion 16*c*. The thumb button 68, the rib 70 and the post 72 are integral with each other and spring element 62. As shown in FIGS. 1 and 5, the length of the pocket 74 is greater than the length of the post 72 so that the spring element 62 may be lowered by applying a downward force to the thumb button 68.

As shown in the illustrated embodiment, the blade carrier 16 is of a single piece, unitary construction and preferably composed of a molded plastic, such as, for example, polypropylene. Single piece construction of the blade carrier 16 reduces the number of separate components typically required by prior art utility knives. A living hinge 76 is formed between the first end 62*a* of the spring element 62 and the cutting blade upper wall portion 30. As is well known in the art, a living hinge is a thin piece of plastic between adjoining structures. As shown in FIG. 5, the spring element 62 is coupled to and pivots along the cutting blade upper wall portion 30. It will be appreciated by those skilled in the art that other coupling mechanisms, besides the living hinge 76, may be used to couple the spring element 62 to the cutting blade upper wall portion 30.

As will be appreciated by those skilled in the art, the elasticity and spring constant of the spring element 62 is dependent on the exact type of plastic used to form the blade carrier 16 as well as the physical dimensions of the spring element 62. As shown in FIG. 5, the length of the spring element 62 is slightly longer than the distance between the living hinge 76 and the flange slot 66. With the flange 64 engaged in the flange slot 66, the spring element 62 is forced upwards away from the third portion 16*c*. The interaction of the recessed beveled surface 65 with the complementary beveled surface 67, along with the length of the spring element 62, projects the spring element 62 upwards.

Figure 2:
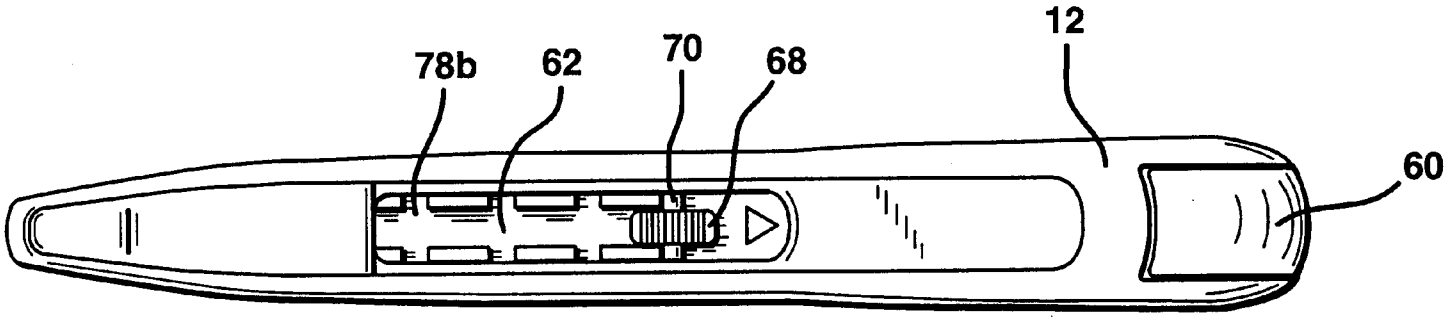
FIG. 2 is a top view of the utility knife of FIG. 1.

Once the cutting blade 14*a* is properly positioned within the first portion 16*a* of the blade carrier 16, the blade carrier 16 is inserted into the knife handle 12 by positioning the cutting blade 14*a* and the first portion 16*a* in the second opening 20. As shown in FIGS. 1 and 2, the slot 22 includes a plurality of notches which correspond to and engage the rib 70 of the button 68. The rib 70 engages the right most notch 78*a* as the blade carrier 16 is passed through the inner portion 24 of the knife handle 12. The upward force exerted by the spring element 62 maintains the rib 70 within the notch 78*a*. In the illustrated embodiment, the slot 22 is shown on the top surface of the knife handle 12. However, it will be appreciated by those skilled in the art that the slot 22 may be positioned on either side or on the bottom of the knife handle 12.

Figure 6:
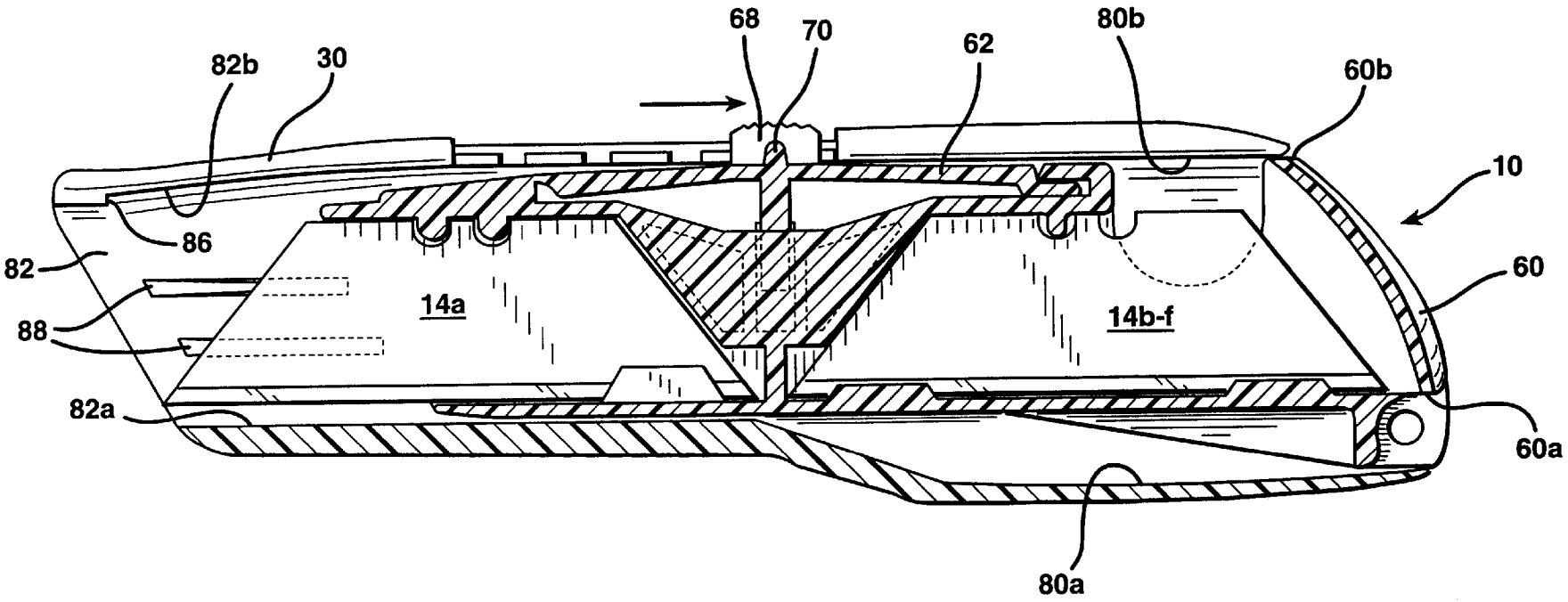
FIG. 6 is a cross-sectional view of the utility knife of FIG. 1 with a cutting blade in a fully retracted position.
Figure 8:
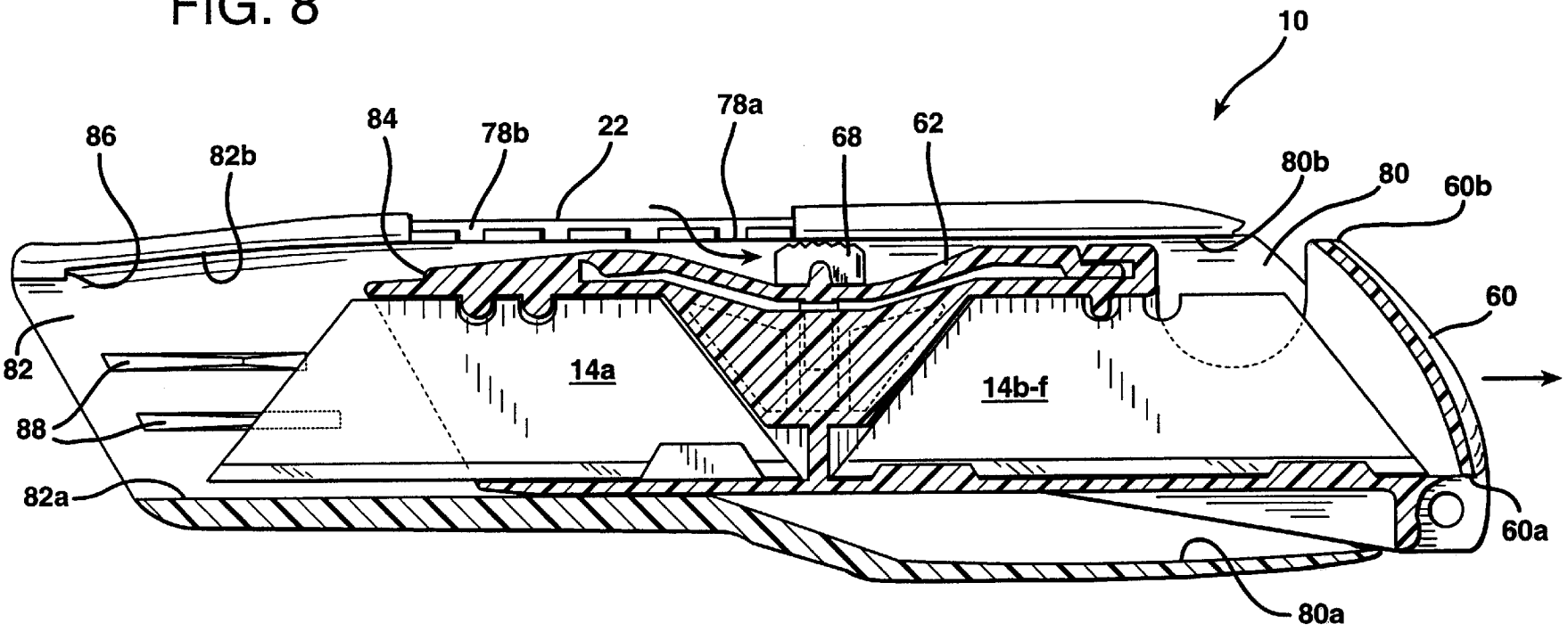
FIG. 8 is a cross-sectional view of the utility knife of FIG. 1 with the blade carrier in the process of being removed from the knife handle.

As shown in FIG. 6, the utility knife 10 is in a fully retracted position with the rib 70 within the notch 78*a* as the cutting blade 14*a* is maintained within the knife handle 12. The cutting blade 14*a* may be extended, as shown in FIG. 7, by depressing the button 68 and applying a longitudinal force in the direction of the arrow as illustrated. When the button 68 is depressed, the rib 70 is released from within the notch 78*a*. The simultaneous application of longitudinal force drives the blade carrier 16, and hence, the cutting blade 14*a* out of the knife handle 12. The blade carrier 16 is again locked in place as the rib 70 engages another of the plurality of notches 78. The utility knife 10 is in a fully extended position, as shown in FIG. 7, with the rib 70 engaged with the leftmost notch 78*b*. As will be appreciated by those skilled in the art, the utility knife 10 may be placed in any desired intermediate position depending on the total number and spacing of notches 78. As shown in the illustrated embodiment, the utility knife 10 has a total of four positions: fully retracted; fully extended; and two intermediate positions. As shown in FIG. 8, the blade carrier 16 is released from the knife handle 12 by depressing the button 68 through the slot 22 and applying longitudinal force in the direction shown by the arrows. The button 68 as well as the blade carrier 16 pass through the inner portion 24 of the knife handle 12. The blade carrier 16 is removed from the knife handle 12 by grasping the cover portion 60 or the extension portion 46*c* and pulling the blade carrier 16 out of the knife handle 12. The present cutting blade 14*a* may be flipped and reused or an extra blade 14*b* may be inserted into the blade carrier 16. The blade carrier 16 is then reinserted into the knife handle 12, the button 62 and the rib 70 engage a notch 78 in slot 22, and the utility knife 10 is ready for use.

As shown in FIGS. 6 and 7, the cover portion 60 of the blade carrier 16 is shaped and dimensioned to fit within a first chamber 80 of the inner portion 24. The lower and upper edges 60*a*, 60*b* of the cover portion 60 move along the lower and upper surfaces 80*a*, 80*b* of the first chamber 80. As configured, the cover portion 60 also provides support for the blade carrier 16 when positioned within the knife handle 12. The knife handle 12 includes a second chamber 82 which is slightly narrower than the first chamber 80. The second chamber 82 is sized so that the bottom portion of the cutting blade base portion 26 moves along a bottom edge 82*a* of the second chamber 82. As shown in FIG. 7, the lower surface of the cutting blade upper wall portion 30 is shaped to correspond with the shape of the upper edge 82*b* of the second chamber 82. When the utility knife 10 is in the fully extended position, the blade carrier 16 is firmly secured within the knife handle 12. For added stability, the blade carrier 16 includes a shoulder 84 positioned along the cutting blade upper wall portion 30 which engages a shoulder 86 positioned along the upper edge 82*b* of the second chamber 82; see also FIGS. 1 and 6. The sloped portion 46*c* is positioned so as contact another sloped portion 87 when the blade carrier 16 is fully extended. The sloped portion 87 marks the transition from the first chamber 80 to the second chamber 82. The knife handle 12 also includes at least one, and preferably two, longitudinally extending ribs 88 located within the second chamber 82; see FIGS. 6–8. The ribs 88 provide support for the cutting blade 14*a* when positioned within the knife handle 12.

The present invention in its most preferred form provides a utility knife of only two piece construction (excluding the cutting blade). Unitary construction of the knife handle 12 provides increased support for the cutting blade 14*a* even when it is subjected to severe lateral or twisting forces. Unlike some prior art utility knives, the knife handle 12 and the blade opening 18 will not separate so that the cutting blade 14*a* is maintained within the utility knife 10. Finally, unitary construction of the blade carrier 16 alleviates the need for separate spring elements and thumb buttons as required by the prior art. The cutting blade 14*a* may be simply, quickly and easily replaced by removing the blade carrier 16 from the knife handle 12 without a need for any tools such as a screwdriver. A new cutting blade 14*a* is simply positioned within the designated area. There are no screws or other extra parts which need to be considered. The single piece blade carrier 16 is inserted into the knife handle 12 and the utility knife 10 is ready for immediate use.

Having described the invention in detail and by reference to preferred embodiments thereof, it will be apparent that modifications and variations are possible without departing from the scope of the invention which is defined in the appended claims.

What is claimed is:

1. A utility knife comprising:

a knife handle including a blade opening at a first end of said handle, a second opening at an opposite end of said handle, a slot on a surface of said knife handle, and an inner portion;

a replaceable blade for said knife; and a blade carrier adapted for mounting said replaceable blade thereon, said blade carrier including a spring element having a button, said spring element adapted to engage said slot on said knife handle when said blade carrier is inserted into said inner portion of said knife handle through said second opening, said blade carrier being removable from said knife handle through said second opening therein by depressing said button through said slot to said inner portion of said knife handle to permit said blade to be replaced.

2. The utility knife as claimed in claim 1 wherein said knife handle is of unitary construction.

3. The utility knife as claimed in claim 2 wherein said knife handle is comprised of a metal.

4. The utility knife as claimed in claim 1 wherein said blade carrier is of unitary construction.

5. The utility knife as claimed in claim 4 wherein said blade carrier is comprised of plastic.

6. The utility knife as claimed in claim 1 wherein said spring element and said button are integral with said blade carrier.

7. The utility knife as claimed in claim 6 wherein a first end of said spring element and a first portion of said blade carrier form a living hinge.

8. The utility knife as claimed in claim 7 wherein a second end of said spring element includes a flange and a second portion of said blade carrier includes a flange slot, said flange of said spring engaging said flange slot of said blade carrier.

9. The utility knife as claimed in claim 1 wherein said slot includes a plurality of notches and said spring element is adapted to engage said notches.

10. The utility knife as claimed in claim 9 wherein said button includes at least one laterally extending rib, said rib adapted to engage said notches of said slot.

11. The utility knife as claimed in claim 1 in which said replaceable blade includes at least one locating notch along an edge thereof and said blade carrier includes at least one post for receiving said locating notch in said blade when said blade is mounted on said blade carrier.

12. The utility knife as claimed in claim 1 in which said blade carrier includes a blade storage area in a recess thereof.

13. The utility knife as claimed in claim 12 in which said replaceable blade includes at least one locating notch along an edge thereof and said blade storage area includes at least one post for receiving said notch in said blade when said blade is mounted in said blade storage area.

14. The utility knife as claimed in claim 1 wherein said inner portion of said knife handle includes at least one rib for supporting said blade within said knife handle.

15. A utility knife comprising:

a knife handle including a blade opening at a first end of said handle, a second opening at an opposite end of said handle, and a slot on a top surface of said knife handle;

a replaceable blade for said knife; and a blade carrier adapted for mounting said replaceable blade thereon, said blade carrier including a spring element adapted to engage said slot on said knife handle when said blade carrier is inserted into said knife handle through said second opening, said top surface of said knife handle being parallel to a cutting surface of said blade, and said blade carrier being removable from said knife handle by depressing said spring element through said slot and pulling said blade carrier through said second opening in said knife to permit said blade to be replaced.

16. The utility knife as claimed in claim 15 wherein said knife handle is of unitary construction.

17. The utility knife as claimed in claim 15 wherein said blade carrier is of unitary construction.

18. The utility knife as claimed in claim 15 wherein said slot includes a plurality of notches and said spring element is adapted to engage said notches.

19. The utility knife as claimed in claim 18 wherein said spring element comprises a button having at least one laterally extending rib, said rib adapted to engage said notches of said slot.

20. The utility knife as claimed in claim 15 wherein a first end of said spring element and a first portion of said blade carrier form a living hinge.

21. A utility knife comprising:

a knife handle including a blade opening at a first end of said handle, a second opening at an opposite end of said handle, and a slot;

a replaceable blade for said knife; and a blade carrier adapted for mounting said replaceable blade thereon, said blade carrier including a spring element adapted to engage said slot on said knife handle when said blade carrier is inserted into said knife handle through said second opening, said blade carrier being removable from said knife handle by depressing said spring element through said slot and pulling said blade carrier through said second opening in said knife handle to permit said blade to be replaced, wherein said blade carrier is of unitary construction.

22. The utility knife as claimed in claim 21 wherein said knife handle is of unitary construction.

23. The utility knife as claimed in claim 21 wherein said slot includes a plurality of notches and said spring element is adapted to engage said notches.

24. The utility knife as claimed in claim 23 wherein said spring element comprises a button having at least one laterally extending rib, said rib adapted to engage said notches of said slot.

25. The utility knife as claimed in claim 21 wherein a first end of said spring element and a first portion of said blade carrier form a living hinge.

* * * * *